US012161921B2

(12) United States Patent
Meyer

(10) Patent No.: US 12,161,921 B2
(45) Date of Patent: Dec. 10, 2024

(54) COMPOSITE PUTTER HEAD WITH HIGH MOMENT OF INERTIA

(71) Applicant: LA Golf Partners LLC, Newport Beach, CA (US)

(72) Inventor: Jeffrey William Meyer, San Diego, CA (US)

(73) Assignee: LA GOLF PARTNERS LLC, Newport Beach, CA (US)

( * ) Notice: Subject to any disclaimer, the term of this patent is extended or adjusted under 35 U.S.C. 154(b) by 0 days.

(21) Appl. No.: 17/580,473

(22) Filed: Jan. 20, 2022

(65) Prior Publication Data

US 2023/0226418 A1 Jul. 20, 2023

(51) Int. Cl.
*A63B 53/04* (2015.01)

(52) U.S. Cl.
CPC ..... *A63B 53/0487* (2013.01); *A63B 53/042* (2020.08); *A63B 53/0441* (2020.08); *A63B 2053/0491* (2013.01)

(58) Field of Classification Search
CPC ..... A63B 53/0487; A63B 53/0465
See application file for complete search history.

(56) References Cited

U.S. PATENT DOCUMENTS 4,508,350 A * 4/1985 Duclos ..... A63B 53/0487 473/254
4,569,524 A * 2/1986 Quijano ..... A63B 53/0466 473/342
5,340,107 A * 8/1994 Baker ..... A63B 53/0487 473/340
6,179,727 B1 * 1/2001 Giordano ..... A63B 60/02 473/341
6,332,848 B1 12/2001 Long et al.
6,386,991 B1 * 5/2002 Reyes ..... A63B 53/0487 473/340
6,435,976 B1 * 8/2002 Galliers ..... A63B 53/0487 473/251
6,450,894 B1 * 9/2002 Sun ..... A63B 60/02 473/341
6,511,387 B2 * 1/2003 Grieb ..... A63B 60/02 473/341
6,547,676 B2 4/2003 Cackett et al.
6,902,496 B2 * 6/2005 Solheim ..... A63B 53/0487 473/341
6,951,517 B2 * 10/2005 Lindsay ..... A63B 53/0487 473/340
7,083,526 B2 * 8/2006 Durnin ..... A63B 53/065 473/340
7,604,548 B2 * 10/2009 Cole ..... A63B 53/065 473/409
8,038,545 B2 10/2011 Soracco
(Continued)

OTHER PUBLICATIONS

Brown, Ron, "Moment of Inertia in Golf Club Design," https://web.calpoly.edu/~rbrown/MOI.html, Oct. 21, 2020, pp. 1-7.

*Primary Examiner* — Alvin A Hunter
(74) *Attorney, Agent, or Firm* — Seyfarth Shaw LLP

(57) ABSTRACT

A putter is described. The putter includes a composite putter head having a high moment of inertia. The putter also includes a putter head face connected to the composite putter head. The putter further includes a hosel for mounting to a putter shaft. The putter also includes a plurality of sole weights mounted in a sole of the composite putter head.

4 Claims, 8 Drawing Sheets

(56) References Cited

U.S. PATENT DOCUMENTS

| | | | | |
|---|---|---|---|---|
| 8,979,673 | B2 | 3/2015 | Morales et al. | |
| 9,144,717 | B2 * | 9/2015 | Franklin | A63B 53/0487 |
| 9,192,832 | B2 * | 11/2015 | Parsons | A63B 53/0487 |
| 9,220,960 | B2 * | 12/2015 | Schartiger | A63B 53/0487 |
| 9,233,283 | B2 * | 1/2016 | Schweigert | A63B 53/065 |
| 9,387,375 | B2 * | 7/2016 | Schweigert | A63B 53/065 |
| 9,440,124 | B2 * | 9/2016 | Parsons | A63B 53/0487 |
| 9,901,792 | B2 * | 2/2018 | Franklin | A63B 53/047 |
| 9,956,463 | B2 * | 5/2018 | Franklin | A63B 60/54 |
| 10,046,211 | B2 * | 8/2018 | Franklin | A63B 53/065 |
| 10,279,229 | B1 * | 5/2019 | Day | A63B 53/007 |
| 10,493,331 | B2 * | 12/2019 | Kroloff | A63B 60/42 |
| 2004/0063516 | A1 * | 4/2004 | Cameron | A63B 53/0487 473/340 |

* cited by examiner

COMPOSITE PUTTER HEAD WITH HIGH MOMENT OF INERTIA

FIELD OF THE DISCLOSURE

Aspects of the present disclosure generally relate to golf putters, and more particularly to techniques and apparatuses for improved composite putter heads with high moment of inertia.

BACKGROUND

A putter is a club used in the sport of golf to make relatively short, low-speed strokes to roll a golf ball into a cup (e.g., a cylindrical hole) from a relatively short distance, which is referred to as putting a golf ball. A putter is distinguished from other golf clubs (e.g., irons, woods, and wedges) by having a club head with a very flat, low-profile and low-loft striking face. Putters may have other features, such as bent shafts, non-circular grips, and positional guides, which are not allowed on other clubs.

Putters are generally used very close to the cup, most often on a putting green. In some cases, putters may be used from the fringes or roughs surrounding the green, which may be suitable for putting. While the rules of golf specify the maximum number of clubs a player may carry and do not specify a particular club, the putter is a club used by nearly every golfer. In particular, putters are specialized clubs for a specific task and nearly every golfer carries one in their bag of clubs.

Golf clubs, including putters, have shafts with a grip and a club head. The shaft may be a tapered tube made of metal, such as steel, or carbon fiber composite, known as graphite. Shafts may range in diameter from 0.5 inches near the grip end and have a length between 32 to 46 inches. Shafts may weigh between 1.6 to 6.5 ounces, depending on materials and length. Shaft are a key component of the modern golf club and works in conjunction with the club head during the golfer's swing. Shafts may be assigned a flex rating that allows a player to select a shaft with desired properties specified to produce a better game. For example, a flex rating may help a player determine specific criteria specified to launch the ball higher, or lower. In addition, depending on the flex rating, the timing of a player's swing may be adjusted to load and unload the shaft at a precise moment specified for maximum power. These characteristics may also be incorporated into putters.

Most putter heads are considered standard weight at 350 grams. The weight in a putter may be associated with three separate concepts: head weight, grip weight, and counterweight. The head weight affects how a player squares up the club face at ball impact. For example, some players prefer to use a lighter head weight on fast greens and a heavier head on slow greens. Grip weight may influence overall swing weight and may also make the same putter head feel lighter. The counterweight adds weight to the top end of the putter.

There is a desire in the art for a composite head for putters that allows for a high moment of inertia. In particular, there is a desire for a putter head fabricated from milled carbon fiber and weighing less than 108 grams, which allows for a greater range of sole weights. This desired putter head may be milled in a variety of shapes and customized to suit player specifications.

SUMMARY

A putter is described. The putter includes a composite putter head having a high moment of inertia. The putter also includes a putter head face connected to the composite putter head. The putter further includes a hosel for mounting to a putter shaft. The putter also includes a plurality of sole weights mounted in a sole of the composite putter head.

A method of manufacturing a composite putter head is described. The method includes placing an initial pre-preg layer in first direction. The method also includes stacking an additional pre-preg layer on the initial pre-preg layer in a second direction. The method further includes repeating the placing and stacking for a plurality of directions to form a stack assembly block. The method also includes heat curing the stack assembly block to provide a heat cured stack assembly block. The method further includes machining the heat cured stack assembly block into a selected putter head shape. The method also includes decorating the selected putter head shape after the machining.

The foregoing has outlined rather broadly the features and technical advantages of examples according to the disclosure in order that the detailed description that follows may be better understood. Additional features and advantages will be described. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed, both their organization and method of operation, together with associated advantages will be better understood from the following description when considered in connection with the accompanying figures. Each of the figures is provided for the purposes of illustration and description, and not as a definition of the limits of the claims.

BRIEF DESCRIPTION OF THE DRAWINGS

So that the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects. The same reference numbers in different drawings may identify the same or similar elements.

DETAILED DESCRIPTION

Figure 1:
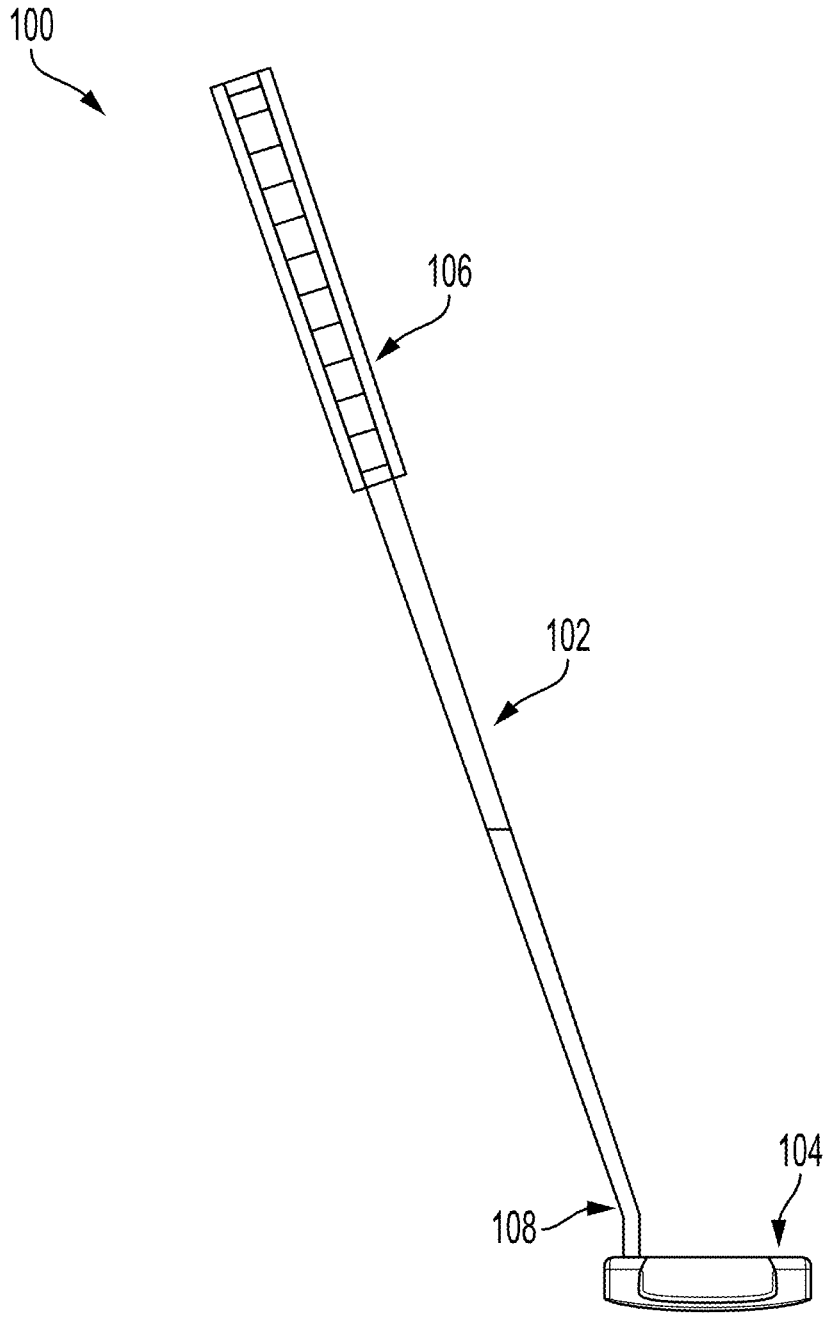
FIG. 1 is a diagram illustrating a putter having a composite putter head fabricated, in accordance with various aspects of the present disclosure.

Various aspects of the disclosure are described more fully below with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings, one skilled in the art should appreciate that the scope of the disclosure is intended to cover any aspect of the disclosure disclosed, whether implemented independently of or combined with any other aspect of the disclosure. For example, an apparatus may be implemented or a method may be practiced using any number of the aspects set forth. In addition, the scope of the disclosure is intended to cover such an apparatus or method, which is practiced using other structure, functionality, or structure and functionality in addition to or other than the various aspects of the disclosure set forth. It should be understood that any aspect of the disclosure disclosed may be embodied by one or more elements of a claim.

Putting is the most precise aspect of golf. The putter is designed to give a golfer every technical advantage, including a smooth stroke, good glide, smooth impact, and a bounce-free topspin launch of the ball. In addition, the putter should be fit to the individual golfer with respect to head style, shaft angle, and length.

All golf clubs share basic characteristics and the differences between various clubs of similar type is the loft, or the angle, between the club face and the vertical plane. Loft is the primary determinant of the ascending trajectory of the ball, with the tangential angle of the club head swing arc at ball impact being secondary. The impact of the club compresses the ball and grooves on the club face impart backspin to the ball. The compression and backspin create lift.

Putters are a special class of clubs with a loft that may not exceed ten degrees. They are designed to roll the ball along grass, generally from a point on the green to the hole. Putters do have loft, which may be five degrees from perpendicular at impact. This loft assists in lifting the ball from any indentation the ball may have made in the grass. In addition, putters may include grooves on the face to encourage rolling rather than skidding at impact. These grooves may increase rolling distance and may reduce bouncing over the turf.

While putters share characteristics with other golf clubs, they are unique in other ways. Putters are the only clubs that may have two striking faces, non-circular grip cross-sections, bent shafts or hosels, and aim assisting appendages. The hosel is the portion of the club head to which the shaft attaches. Hosels are integral to the balance, feel, and power of the club, including putters.

Hosels may feature in putter construction in several ways. Three tip geometries may be used for putter shafts: a straight shaft where the tip of the shaft is epoxied into a hosel, bent tip shafts, and putter heads where the shaft is epoxied over the top of a stud, or a shaft over hosel design. Face balanced putters may use straight shafts, while a toe-balanced putter may use an angled shaft, placing the shaft slightly to the side of the putter head clubface.

The United States Golf Association places moment of inertia restrictions on drivers, which are restricted to a maximum moment of inertia of 5,900 g-cm$^2$. Putter heads have no such restrictions placed on moment of inertia. One popular putter has a moment of inertia of approximately 4,000 g-cm$^2$. Putters manufactured in accordance with aspects of the present disclosure may have a moment of inertia (MOI) between 6661 g-cm$^2$ and 7471 g-cm$^2$.

Moment of inertia indicates how much resistance a club head has to twisting. A higher moment of inertia provides more resistance and makes the club more forgiving in play. For most golfers, a higher moment of inertia in a golf club is a good thing. When a golf ball is struck with a golf club, the club twists, no matter where on the club face the ball is struck. The most energy is transferred at a spot golfers call the "sweet spot" and this causes the golf ball to fly the furthest. The further away from the "sweet spot" the more the club twists at impact, adversely affecting flight distance. For putters a higher moment of inertia helps keep putts on the desired line and closer to the desired distance.

The moment of inertia for a golf club increases when the golf club has more weight at the extremes of the golf club. This is known as "perimeter weighting." Moving weight to the outside edges of the club face provides more support to off-center strikes. This is especially useful for putting where precision is needed for both distance and the desired line to the pin.

Some aspects of the present disclosure provides a composite putter head with a high moment of inertia. A putter is described that includes the composite putter head having a high moment of inertia. The putter also includes a putter head face connected to the composite putter head. The putter further includes a hosel for mounting to a putter shaft. The putter also includes a plurality of sole weights mounted in a sole of the composite putter head.

The present disclosure provides a method of manufacturing a composite putter head with a high moment of inertia. The method includes placing an initial pre-preg layer in first direction. The method also includes stacking an additional pre-preg layer on the initial pre-preg layer in a second direction. The method further includes repeating the placing and stacking for a plurality of directions to form a stack assembly block. The method also includes heat curing the stack assembly block to provide a heat cured stack assembly block. The method further includes machining the heat cured stack assembly block into a selected putter head shape. The method also includes decorating the selected putter head shape after the machining.

FIG. 1 is a diagram illustrating a putter 100, in accordance with aspects of the present disclosure. In this example, the putter 100 includes a putter shaft 102, a composite putter head 104, a grip 106, and a hosel 108. The putter shaft 102 may be tapered and hollow and may be made of a homogenous material, such as steel, or a carbon fiber composite, known as graphite. The shaft may have a steel core in the tip section only, or tip and mid-section, or the entire shaft length may be a homogeneous steel core. The putter shaft 102 may be a multi-material shaft composed of composite materials and steel and may be composed of a steel tip or a steel mid-section.

The putter shaft 102 may be described in terms of a shaft flex. As described, the shaft flex may refer to an amount that the shaft will bend when placed under load, which occurs during putting. A stiffer shaft may not flex much and may involve more power during the golfer's swing, producing a higher club speed at ball impact. In contrast, a more flexible shaft may flex more and may involve less power, however, the shaft may torque and over-flex if swung with excessive power, causing the head to not be square at ball impact. Most shaft manufacturers offer a variety of flexes in shafts to allow golfers to select the most suitable shaft for their game and ability. The putter shaft 102 may be bent near the club head mounting to provide a line and club head position that places the line of the straight portion of the putter shaft 102 at the "sweet" or preferred spot of the subhead of the club head, where the ball should be for a more accurate putt.

In this example, the putter shaft 102 is secured to the composite putter head 104 using a hosel 108 or may be bonded to a putter head having a stud in place of a hosel 108. The hosel 108 may be stainless steel. The hosel 108 may also be offset to place the putter shaft 102 of the putter 100 in line with the center of the ball at impact. The putter shaft 102 thus points directly into the center of the ball at impact. The hosel 108 extends from the composite putter head 104 and into the putter shaft 102 and may not be externally visible. The hosel 108 affects the balance, feel, and power of the putter 100. In addition, the hosel 108 assists in placing minimum mass over the top of the striking face of composite putter head 104, thus lowering the center of gravity of the putter 100.

The composite putter head 104 may have one of a variety of designs, such as those discussed further below in FIGS. 2 and 4. The composite putter head 104 may be of multiple styles including mallet, peripheral weighted, and blade. In addition, the composite putter head 104 may incorporate sole weights to increase the moment of inertia of the composite putter head 104 to reduce twisting if the putter 100 contacts the ball slightly off-center. For example, the sole weights may be tungsten.

The putter shaft 102 includes a grip 106 at one end, opposite the composite putter head 104. The grip 106 may be wrapped in leather or a one-piece sleeve made of rubber, synthetic, or composite material that is slid over the putter shaft 102 and may be secured with an adhesive. The grip 106 allows a player to customize the diameter, consistency, and texturing pattern for a better club fit. The grip 106 may have any cross-section that is symmetrical along a length of the grip 106 through at least one plane. For example, a "shield" profile with a flat top and a curved underside may be used. The grip 106 may taper from thick to thin but may not have thinner sections surrounded by thicker sections (known as "waisting") and may not have thicker sections surrounded by thinner sections (known as "bulges").

Figure 2:
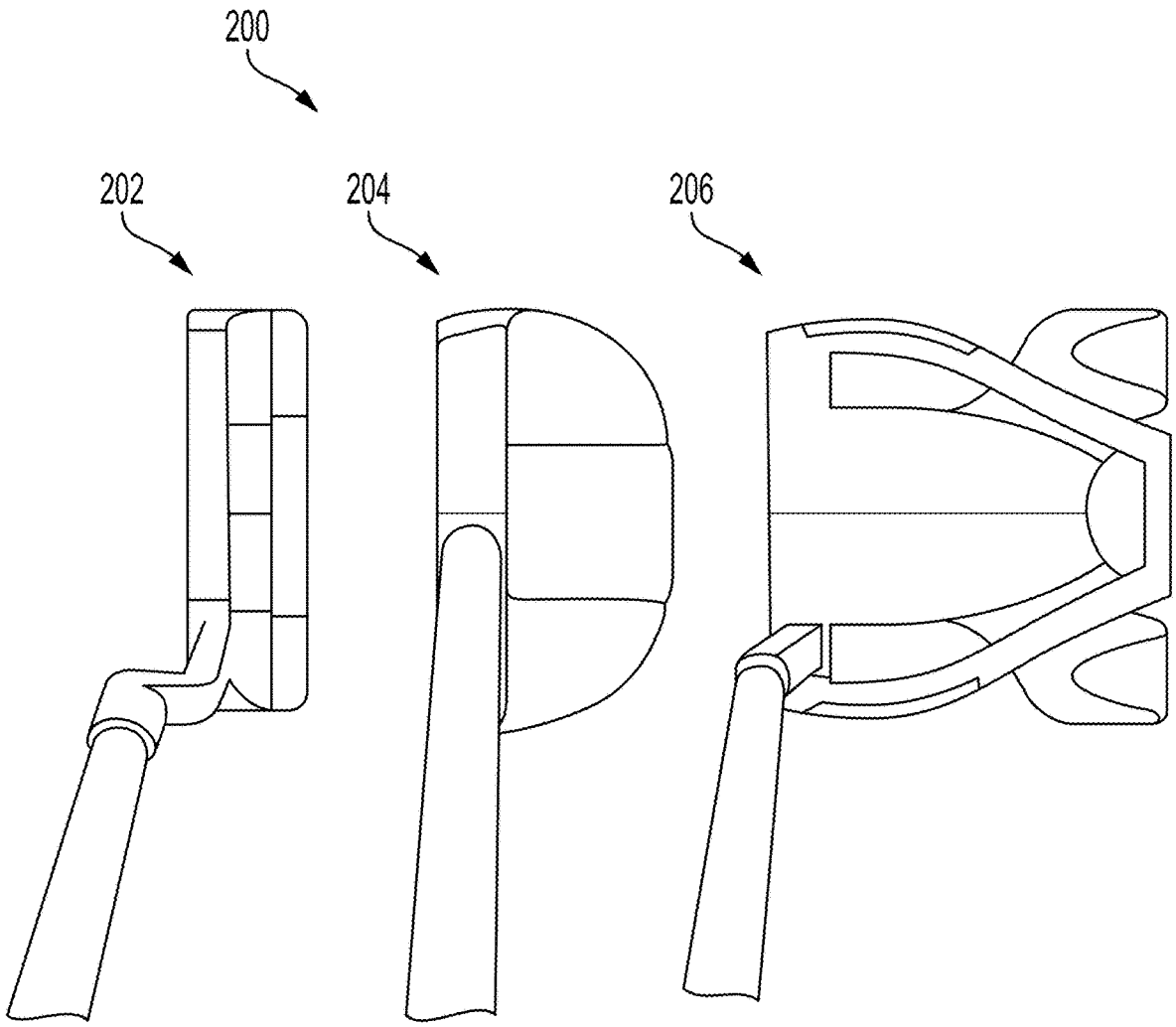
FIG. 2 depicts various putter head designs, in accordance with various aspects of the present disclosure.

FIG. 2 depicts various putter head designs, in accordance with various aspects of the present disclosure. The putter head designs 200 include a blade head 202, a half-mallet head 204, and a mallet head 206. The blade head 202 is a traditional putter head design. The blade head 202 putters are usually lighter. The half-mallet head 204 is heavier than the blade head 202, but is lighter than the mallet head 206. Heavier putters, such as the half-mallet head 204 and the mallet head 206, should produce longer rolls than the blade head 202, when the same force is applied.

Figure 3:
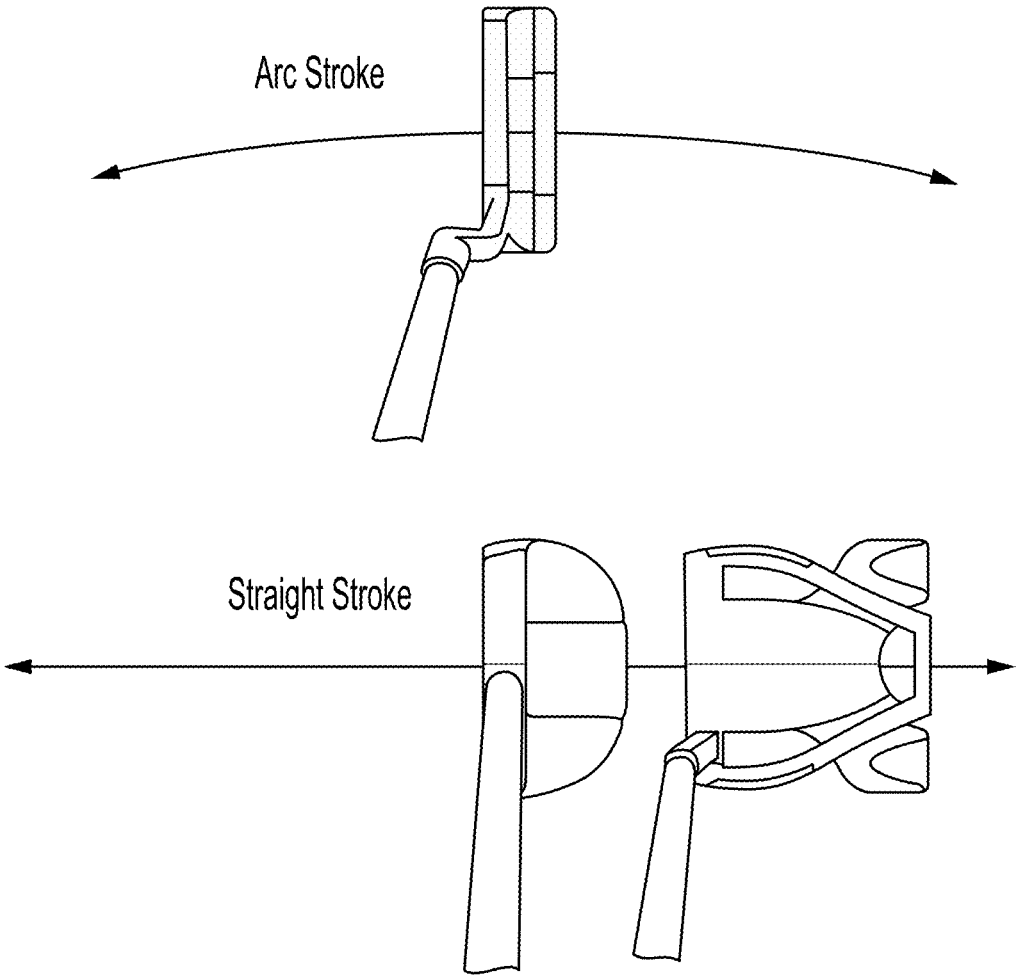
FIG. 3 illustrates putter stroke paths, in accordance with various aspects of the present disclosure.

FIG. 3 illustrates putter stroke paths, in accordance with various aspects of the present disclosure. Putters vary in balance with some putters face balanced and others toe balanced. When a golfer holds a putter in balance over an index finger, some putters have a face that remains level and facing the sky. These are face balanced putters. In contrast, some putters balance over an index finger with the face pointing down. Those putters are toe balanced putters. Certain putting strokes are best suited to face balanced putters while other putting strokes are best suited to toe balanced putters. The blade head 202 putters are generally toe balanced and may be a better fit for golfers that use an arc stroke for their putting swing path. An arc stroke is shown in FIG. 3, with an arc that may vary in curvature during a putting stroke.

Also illustrated in FIG. 3 is a straight stroke. The straight stroke is a simple back and forth stroke. Golfers who use a straight stroke may be best served by the half-mallet head 204 and the mallet head 206 putters. The mallet head 206 putters are designed to be more forgiving when the stroke is not perfectly straight or the golfer makes inconsistent strokes.

Figure 4:
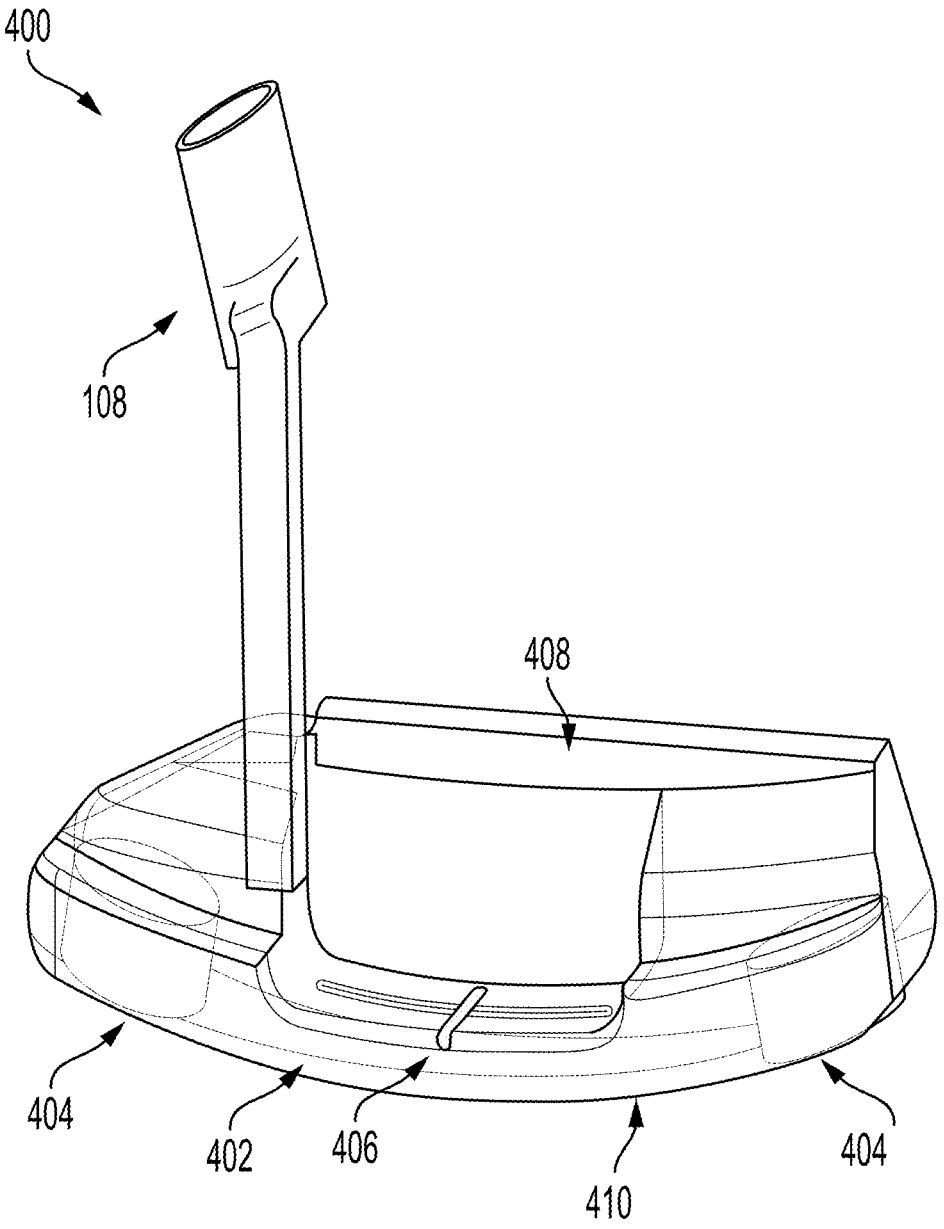
FIG. 4 illustrates a composite putter head with a high moment of inertia, in accordance with various aspects of the present disclosure.

FIG. 4 illustrates a composite putter head with a high moment of inertia, in accordance with various aspects of the present disclosure. The composite putter head assembly 400 includes a composite putter head 402, weights 404, an alignment aid 406, a hosel 108, and a putter head face 408. The composite putter head 402 is milled from a solid block of carbon fiber (e.g., a carbon fiber assembly block), epoxy (e.g., an epoxy assembly block), and/or quartz (e.g., a quartz fiber assembly block). Using carbon fiber or epoxy for the composite putter head 402 allows for a large putter head that may weigh less than 108 grams. At this weight, a putter head may weigh 350 grams and, with a composite putter head 402 of 108 grams, this allows for approximately 240 grams of discretionary weight. The discretionary weight may be allocated to the weights 404, which are typically tungsten, and the hosel 108, which may be stainless steel.

To achieve these weights, the raw carbon block from which the composite putter head 402 is milled may use carbon fiber/epoxy pre-impregnated (pre-preg) sheets weighing less than 100 grams/$m^2$. Carbon fiber, Kevlar, fiberglass, quartz, zylon and other fibers may be used to form the composite putter head 402, such forming the composite putter head from a composite assembly block. The carbon fiber/epoxy pre-preg sheets used allow for a highly machined finish on the composite putter head 402. The composite putter head 402 may also include an alignment aid 406, which may be a simple line, as shown in FIG. 4, or may be similar to alignment aids depicted in FIGS. 5A and 5B. The putter head face 408 may be a face insert or milled onto the striking surface of the composite putter head 402. If a face insert is incorporated, it may be made from a variety of anisotropic materials.

In some aspects of the present disclosure, the composite putter head 402 incorporates perimeter weighting by placing the weights 404 on the perimeter, which may be referred to as a pair of sole weights. For example, the weights 404 may be made from stainless steel, tungsten, brass or lead. By placing the weights 404 in a sole 410 of the composite putter head 402, distal from the putter head face 408, the putter resists twisting and is more forgiving. The placement of the weights 404 may also be used to shift weight away from the putter head face 408 and toward the heel and toe. The putter head face 408 may be formed as a face insert and may be made of anisotropic materials. Tungsten is more dense than lead and is also durable. Lead weights are softer and may be damaged more easily than tungsten.

Figure 5A:
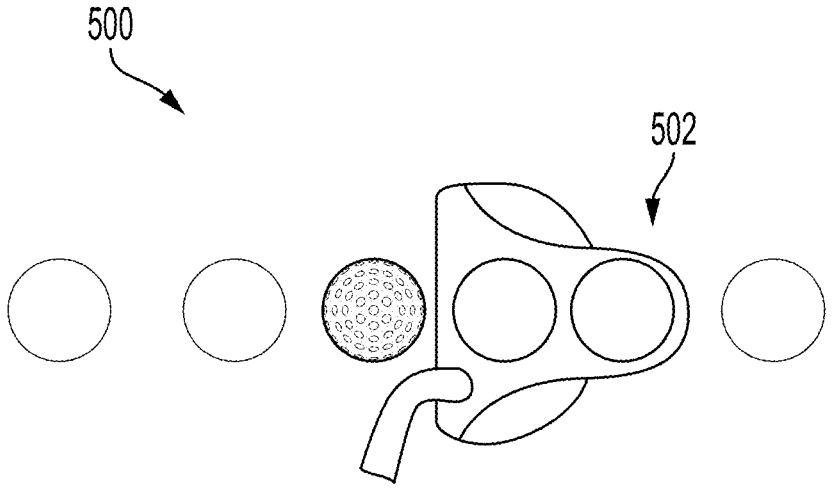
FIGS. 5A and 5B illustrate putting alignment aids integrated into a putter head, in accordance with various aspects of the present disclosure.
Figure 5B:
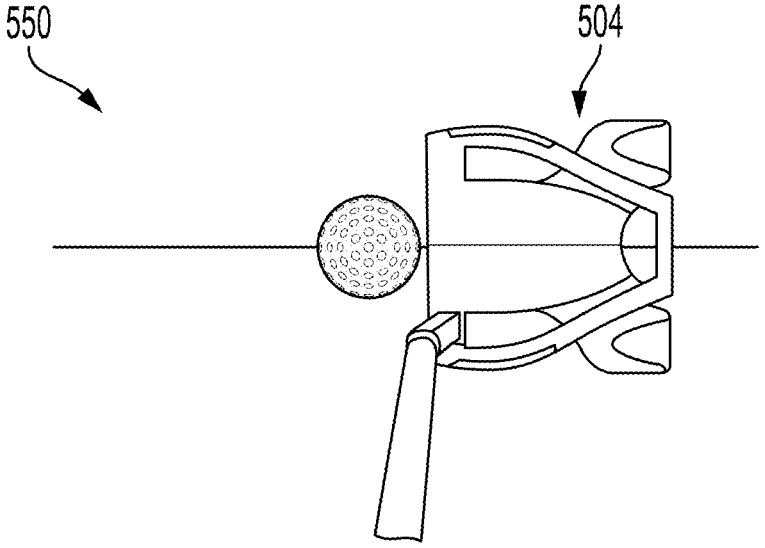

FIGS. 5A and 5B illustrate putting alignment aids integrated into a putter head, in accordance with various aspects of the present disclosure. Putters may have alignment aids incorporated into the design. There are a variety of types of alignment aids 500, which are shown in FIG. 5A, as well as alignment aids 550, which are shown in FIG. 5B. Alignment aids may be more commonly found with the half-mallet head 204 and the mallet head 206 putters (as shown in FIG. 2), as the larger sizes of these putters allows integrating alignment aids into the club head. White circles 502 mimic golf balls, enabling easy viewing of putting stroke alignment. The white circles 502 promote a straight back and forth putting stroke. The line 504 is also incorporated into the half-mallet head 204 and the mallet head 206 putters. Because the line 504 is relatively small, it may also be possible to incorporate a line 504 on some blade head 202 putters. The composite putter head 402 also incorporates an alignment aid 406, as shown in FIG. 4.

Figure 6B:
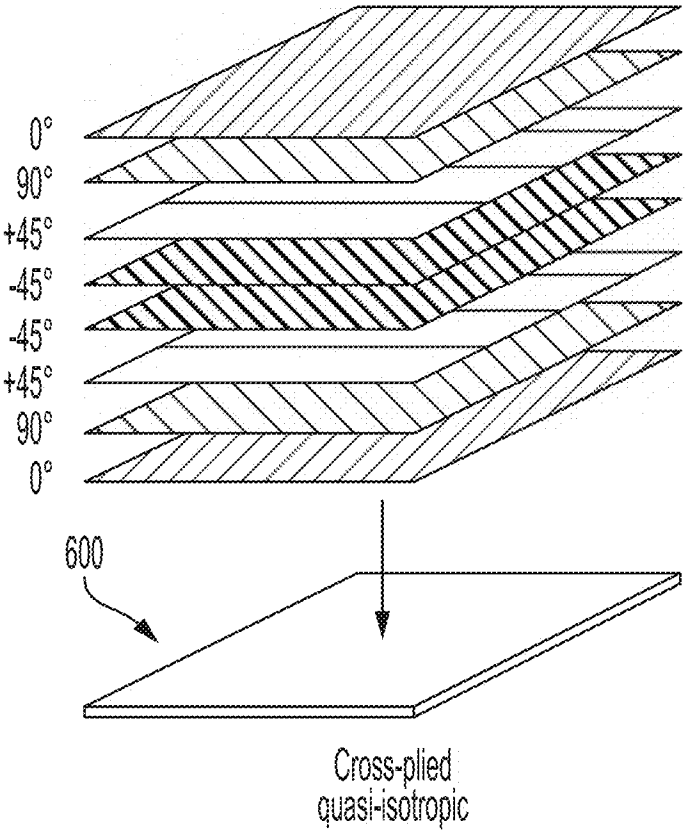
FIGS. 6A and 6B illustrate the construction of carbon fiber assembly stacks, in accordance with various aspects of the present disclosure.
Figure 6A:
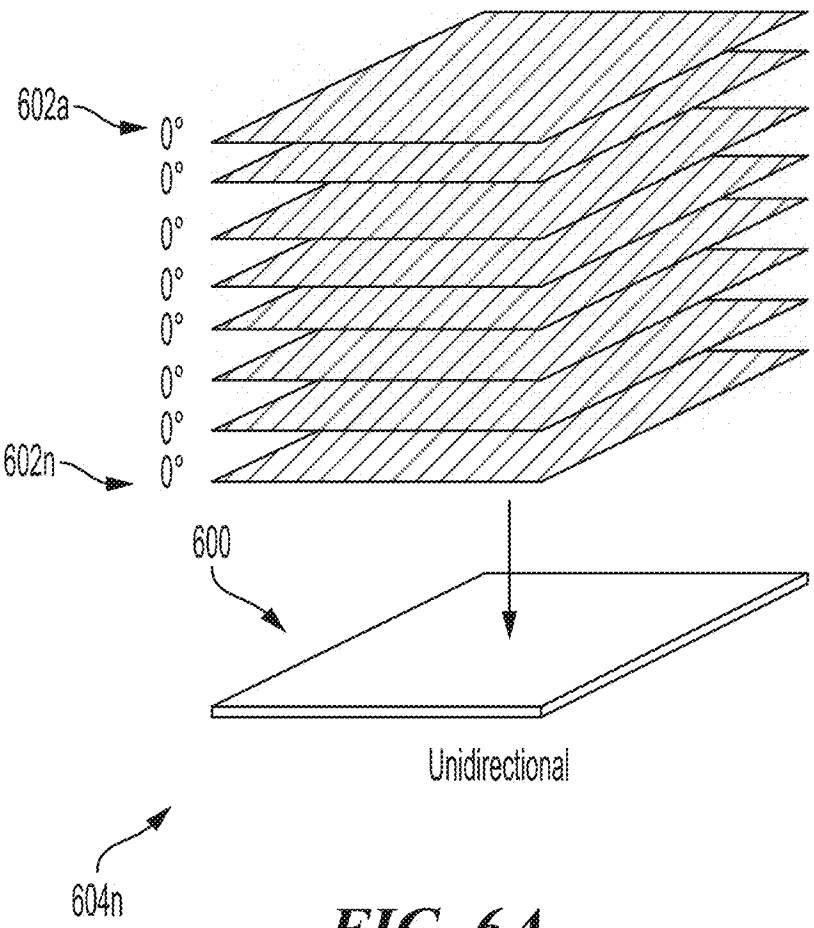

FIGS. 6A and 6B illustrate the construction of carbon fiber stack assemblies, in accordance with various aspects of the present disclosure. FIG. 6A illustrates a carbon fiber stack assembly 600 formed from an isotropic layup with unidirectional plies 602 (e.g., 602*a*, . . . , 602*n*). In some aspects of the present disclosure, the unidirectional plies 602 are implemented using pre-preg layers that are each placed in the same direction (e.g., at zero (0) degrees). In these example, the pre-preg layers are formed from a composite material composed of pre-impregnated fibers and a partially cured polymer matrix, such as an epoxy or phenolic resin, or thermoplastic mixed with liquid rubbers or resins. As shown in FIG. 6A, the carbon fiber stack assembly 600 is formed by pressure bonding the unidirectional plies 602 of the pre-preg layers.

FIG. 6B illustrates the construction of the carbon fiber stack assembly 650 formed from a quasi-isotropic layup with cross-plies 652 (e.g., 652*a*, . . . , 652*n*), in accordance with various aspects of the present disclosure. The carbon fiber stack assembly 650 is formed from a quasi-isotropic layup with cross-plies alternating in different directions (e.g., 0/90/+45/−45/90/0 degrees). The cross-plies 652 of the carbon fiber stack assembly 650 may be made formed from carbon fiber/epoxy pre-preg sheets weighing less than 100 g/m$^2$. The cross-plies 652 may be composed of carbon fiber, fiberglass fiber, boron, Kevlar, Zylon and other fibers commonly used in the fabrication of composite golf shafts.

The composite material of the cross-plies 652, which may be referred to as a pre-preg layer, may comprise pre-impregnated fibers, and a partially cured polymer matrix and may weigh less than 100 grams/m$^2$, in order to achieve the machined finish desired. The tensile modulus of the composite fibers may be between 10,500 ksi to 135 msi. The partially cured polymer matrix may be epoxy or phenolic resin, or may be thermoplastic mixed with liquid rubbers or resins. The fibers often take the form of a weave and the matrix bonds the fibers and the polymer matrix together. The thermoset matrix may be partially cured for ease of handling. The partially cured polymer matrix may be one of epoxy material, phenolic resin, or a thermoplastic mixed with liquid rubber or resin.

Figure 7:
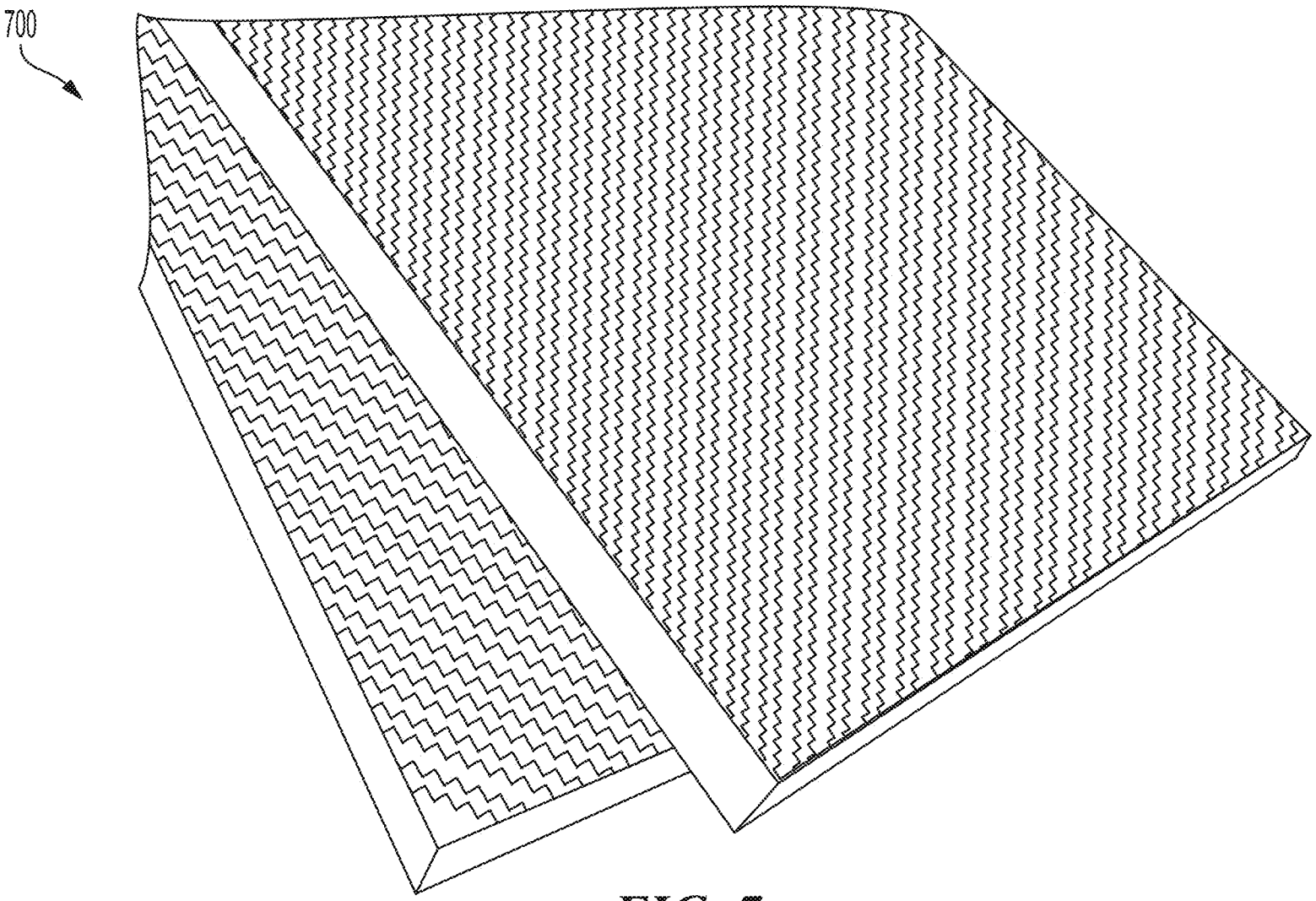
FIG. 7 illustrates a woven carbon fiber sheet from which a carbon fiber block may be formed, in accordance with various aspects of the present disclosure.

Additional layers of pre-preg material may be applied, depending on the desired size and shape of the composite putter head 402. Each additional one of the pre-preg layers is pressure bonded (or autoclave vacuum sealed). After the desired number of pre-preg layers are applied, the carbon fiber stack assembly 650 may be oven cured at a rate and temperature specified by the particular resin system to provide a heat cured stack assembly. Alternatively, the carbon fiber stack assembly is formed from a woven carbon fiber sheet 700, as shown in FIG. 7, in accordance with various aspects of the present disclosure. In some aspects of the present disclosure, the pre-preg material is a one-hundred plus (100+) grams per square meter (GSM) pre-preg material.

After oven-curing, the carbon fiber stack assembly 650 is removed from the oven. The composite putter head 402 is then milled to produce the desired putter head design, such as the blade head 202, the half-mallet head 204, or the mallet head 206 (shown in FIG. 2) from the carbon fiber stack assembly 650. Surface sanding may be performed to remove any additional resin on the surface and to produce a highly machined and polished surface, similar to that found on luxury watches. The weight of the composite putter head 402 may be optimized by selecting pre-preg materials and adhesives based on their density and performance. Alternatively, the composite putter head 402 may be formed using injection molding with short carbon fibers according to a desired putter head shape.

Figure 8:
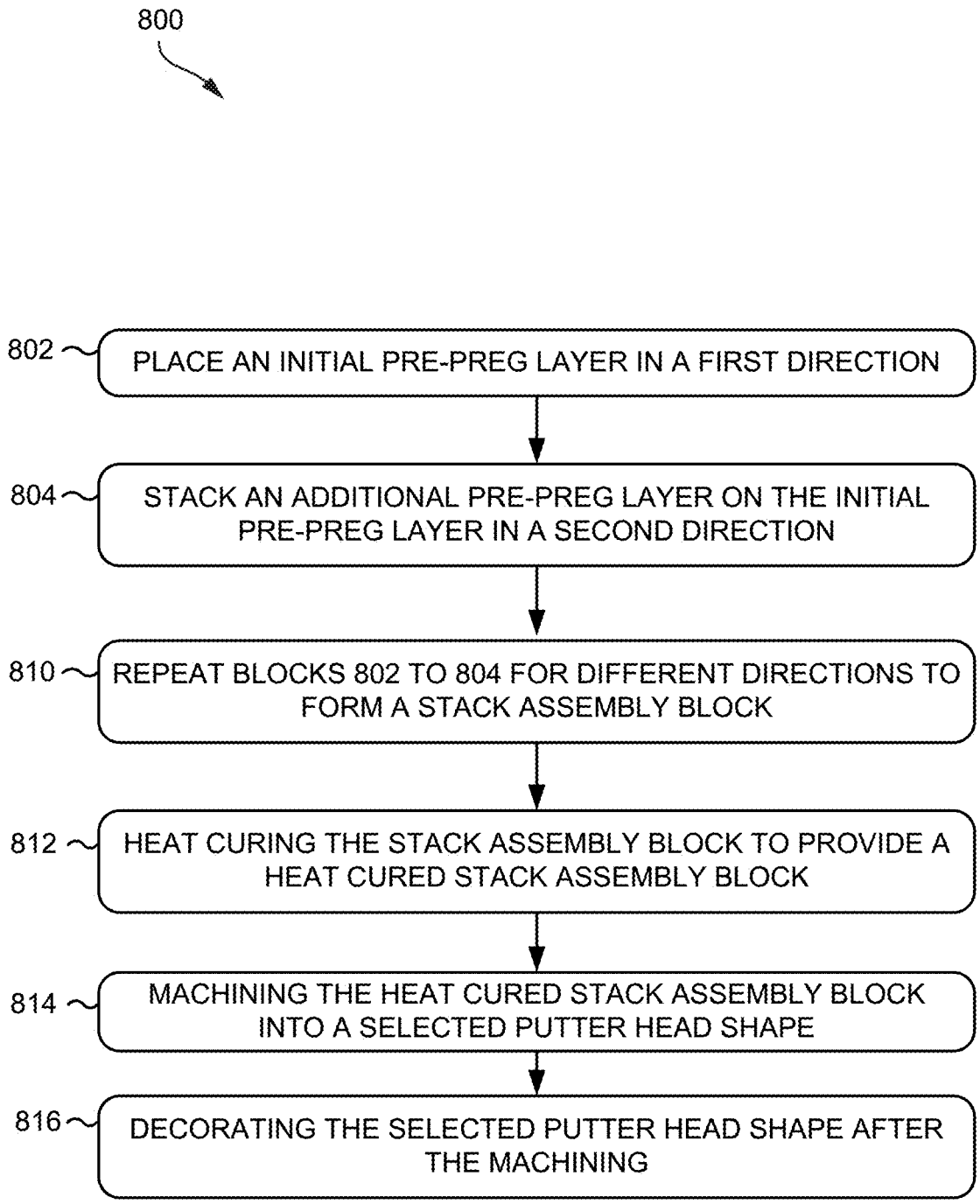
FIG. 8 is a flow diagram illustrating a method of fabricating a composite putter head with a high moment of inertia, in accordance with various aspects of the present disclosure.

FIG. 8 is a flow diagram illustrating a method of fabricating a putter having a composite putter head with a high moment of inertia, in accordance with various aspects of the present disclosure. The method 800 provides a method of fabricating a composite putter head of the putter. The method begins in block 802, in which an initial pre-preg layer is placed in a first direction. The initial pre-preg layer may be one of the cross-plies 652 of FIG. 6B and may be woven. Placing of the initial pre-preg layer may include cutting the cross-plies 652 to a desired size in order to produce a selected putter head shape. Multiple layers of the cross-plies 652 may be prepared and placed in different directions (e.g., 0/90/+45/−45/90/0 degrees).

The process continues at block 804, the process continues with stacking of an additional pre-preg layer on the initial pre-preg layer (e.g., a top surface of the cross-plies 652 of FIG. 6B) in a second direction. The process then continues in block 810 with repeating of blocks 802 to 804 by stacking pre-preg sheets in different directions to form a stack assembly block. The pre-preg layers may be the cross-plies 652 of FIG. 6B in the different directions (e.g., 0/90/+45/−45/90/0 degrees).

The process continues in block 812, in which the stack assembly block is heat cured to form a heat cured stack assembly block. The cure cycle rate and temperature is selected based on the pre-preg layers in blocks 802, 804, and 810. Next, in block 814, the heat cured stack assembly block is machined into a selected putter head shape. The composite putter head 402 of FIG. 4 may be any of the putter shapes (e.g., 202, 204, and 206 of FIG. 2). In block 816, the selected putter head shape is decorated after the machining. The machined surface of the composite putter head 402 may be decorated with manufacturer's logos or other decorative elements and may also have alignment markers, such as white circles 502 or line 504 of FIG. 5B.

The method 800 also includes installing sole weights into a sole of the composite putter head. The method 800 may install the sole weights by milling holes corresponding to the sole weights in the sole of the composite putter head. In some aspects of the present disclosure, the holes for the sole weights are peripherally located on the composite putter head. For example, as shown in FIG. 4, the composite putter head 402 incorporates perimeter weighting by placing the weights 404 on the perimeter, which may be referred to as a pair of sole weights. For example, the weights 404 may be made from tungsten or lead. By placing the weights 404 in a sole 410 of the composite putter head 402, distal from the putter head face 408, the putter resists twisting and is more forgiving.

The resulting composite putter head has a desired weight of less than 108 grams, allowing a greater range of sole weights. The composite putter head may be milled into multiple putter head types and provide a high moment of inertia. The putter head may be customized to suit player needs.

Aspects of the present disclosure provide a composite putter head that may use composite materials where specified to deliver the desired putter head weight. In addition, the composite materials in conjunction provide improved durability and damping characteristics.

As used, the term "component" is intended to be broadly construed as hardware, firmware, and/or a combination of hardware and software. As used, a processor is implemented in hardware, firmware, and/or a combination of hardware and software.

Some aspects are described in connection with thresholds. As used, satisfying a threshold may, depending on the context, refer to a value being greater than the threshold, greater than or equal to the threshold, less than the threshold, less than or equal to the threshold, equal to the threshold, not equal to the threshold, and/or the like.

Even though particular combinations of features are recited in the claims and/or disclosed in the specification, these combinations are not intended to limit the disclosure of various aspects. In fact, many of these features may be combined in ways not specifically recited in the claims and/or disclosed in the specification. Although each dependent claim listed below may directly depend on only one claim, the disclosure of various aspects includes each dependent claim in combination with every other claim in the claim set. A phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

No element, act, or instruction used should be construed as critical or essential unless explicitly described as such. Also, as used, the articles "a" and "an" are intended to include one or more items, and may be used interchangeably with "one or more." Furthermore, as used, the terms "set" and "group" are intended to include one or more items (e.g., related items, unrelated items, a combination of related and unrelated items, and/or the like), and may be used interchangeably with "one or more." Where only one item is intended, the phrase "only one" or similar language is used. Also, as used, the terms "has," "have," "having," and/or the like are intended to be open-ended terms. Further, the phrase "based on" is intended to mean "based, at least in part, on" unless explicitly stated otherwise.

What is claimed is:

1. A putter, comprising:

a composite putter head having a high moment of inertia, the composite putter head being formed from one of a quartz fiber assembly block, a Kevlar® assembly block, a fiberglass assembly block, or a Zylon® assembly block, the high moment of inertia of the composite putter head being at least 6661 g-cm$^2$;

a putter head face connected to the composite putter head;

a hosel for mounting to a putter shaft; and a plurality of sole weights mounted in a sole of the composite putter head.

2. The composite putter head of claim 1, in which the hosel is comprised of stainless steel.

3. The composite putter head of claim 1, in which the plurality of sole weights are comprised of tungsten.

4. The composite putter head of claim 1, in which:

the plurality of sole weights include a pair of sole weights, and the pair of sole weights are peripherally mounted on the sole of the composite putter head.

* * * * *